United States Patent [19]

Donovan

[11] 3,960,133

[45] June 1, 1976

[54] FUEL SAVING APPARATUS

[75] Inventor: James W. Donovan, Washington, D.C.

[73] Assignee: Barry J. Nace, Washington, D.C. ; a part interest

[22] Filed: Mar. 1, 1974

[21] Appl. No.: 447,277

[52] U.S. Cl. ..... 123/198 R; 123/198 D; 251/286

[51] Int. Cl.[2] ..... F02B 77/00

[58] Field of Search ..... 123/198 R, 198 D, 198 DB, 123/97 R, 98, 141; 251/286; 261/65, 23 A

[56] References Cited

UNITED STATES PATENTS

| | | | |
|---|---|---|---|
| 1,096,962 | 5/1914 | Stoffel | 261/65 |
| 1,230,337 | 6/1917 | Stoffel | 261/65 |
| 2,026,948 | 1/1936 | Leibing | 261/65 |
| 2,163,997 | 6/1939 | Handy | 261/65 |
| 2,323,222 | 6/1943 | Holley et al. | 261/23 A |
| 2,328,736 | 9/1943 | Mock | 261/65 |
| 3,077,391 | 2/1963 | Guffra | 123/141 X |
| 3,826,235 | 7/1974 | Pasbrig | 123/141 |

*Primary Examiner*—Charles J. Myhre
*Assistant Examiner*—Ira S. Lazarus
*Attorney, Agent, or Firm*—Barry J. Nace

[57] ABSTRACT

Apparatus is disclosed which is useful for conserving fuel and which comprises a means for preventing or controlling the opening of a valve, commonly called a butterfly valve, of a carburetor, beyond a pre-selected point whereby the flow of fuel into the intake manifold is controlled. Disclosed more particularly is an improved gasket for insertion between the carburetor and intake manifold of a vehicle.

5 Claims, 4 Drawing Figures

FUEL SAVING APPARATUS

BACKGROUND OF THE INVENTION

1. Field of the Invention

This invention is related to vehicles which use fuel such as gasolene as a means of locomotion and a means for conserving that fuel. In a more narrow sense the invention is related to the internal combustion engine as used in vehicles and apparatus for inhibiting the flow of fuel from the carburetor to the intake manifold. The invention is further a gasket body which has been improved and which fits between the carburetor and intake manifold of a vehicle such as an automobile, which improvement impedes or controls the flow of fuel to the engine of the vehicle.

2. Prior Art

Carburetors, intake manifolds and gaskets are all well known in the art. In general, a carburetor contains a valve, frequently referred to as a "butterfly valve" which upon opening permits the flow of fuel into and through the intake manifold, at a rate relative to the degree of opening. The greater the opening, the greater the degree of flow of fuel.

However, with the onset of the "energy crises" and the shortage of fuel such as gasolene for automobiles and the like, there has been the need to conserve such fuel and use it in the most economical manner possible. It has long been known that for such vehicles as automobiles there is a particular speed in terms of miles per hour (mph) which is most desirable from an economical and conservation viewpoint. While such speed varies with each vehicle, the United States Government has established a speed of 55mph as the maximum speed for all vehicles for the reason that such speed is most desirable from the energy crises viewpoint. Unfortunately fuel is wasted by the individual driver who after years of driving at much greater speeds is unable to control his speed at that rate which while desirable seems to be extremely slow.

The butterfly valve in the carburetor functions in response to the degree of acceleration provided by the driver. Thus, if the driver desires to drive his vehicle at 70 mph and accordingly applies pressure to the foot accelerator, the butterfly valve opens much farther then if pressure corresponding to a speed of 55mph is used. Accordingly, the flow of fuel is then greatly increased when driving at 70 mph due to the greater degree of opening of the butterfly valve. Such an opening also occurs when the driver accelerates quickly or presses the accelerator to its limits in order to gain quick bursts of speed and power.

Therefore, in order to properly conserve and economize the use of fuel, it becomes desirable, and essential, to limit the opening or functioning of the butterfly valve according to the speed which is most economical for each make of vehicle.

3. Objects of the Invention

It is, accordingly, an object of this invention to conserve the use of fuel, particularly fuel which is used in internal combustion type vehicles.

It is further an object of this invention to provide a means for reducing the flow of fuel from the carburetor to the intake manifold of an internal combustion engine.

It is further an object of this invention to describe apparatus which can be inserted into the existing carburetor-intake manifold mechanism of the vehicles presently in use, by the individual operator who is not necessarily skilled in the area of vehicles and adjustments to vehicles.

It is further still an object of this invention to describe a gasket suitable for use between the carburetor and intake manifold of an internal combustion engine such as in an auromobile which further contains as as integral part a means for controlling the opening of a valve, such as a butterfly valve, of the carburetor, whereby the amount of fuel consumed is substantially reduced and used most economically.

It is further an object of this invention to describe a carburetor-gasket-intake manifold mechanism or apparatus which is useful in economizing the use of fuel such as gasolene in automobiles and the like.

Other objects of the invention will be obvious to those skilled in the art as the description of this invention proceeds.

BRIEF SUMMARY OF THE INVENTION

In its most specific embodiment this invention is an improved gasket which fits between the intake manifold and the carburetor of an internal combustion engine, characterized as containing an appenditure which is so arranged as to prevent the valve of the carburetor from opening beyond a pre-selected point, whereby the amount of flowing fuel is limited and decreased so as to most economically use the fuel. In a broader sense, the present invention is control apparatus which can easily be adapted to today's vehicles to decrease the flow of fuel from a carburetor to an intake manifold whereby fuel consumption is regulated in accordance with that which is most economical as set forth by the laws and regulations of the land.

DETAILED DESCRIPTION OF THE INVENTION

The present invention is basically an improved gasket which fits between the intake manifold and carburetor and which is further easy to install by the average driver merely by removing the air filter(s) from a vehicle, unbolting the carburetor from the intake manifold and removing the gasket which fits between the carburetor and intake manifold and replacing it with that gasket as improved by this invention.

Figure 1:
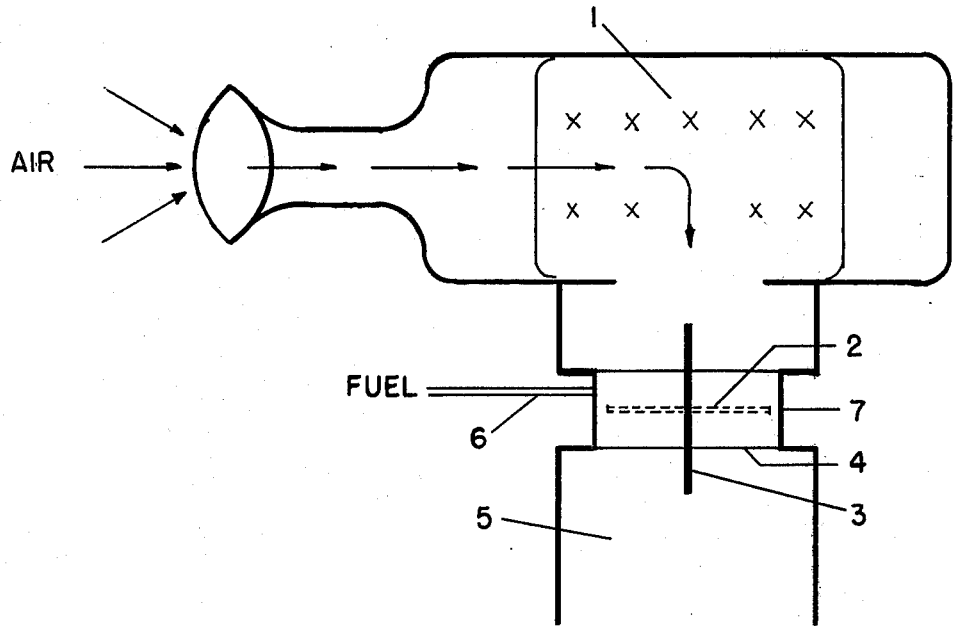
PRIOR ART FIGURE 1
FIG. 1 is a drawing showing the carburetor-intake manifold section of a vehicle utilizing a gasket as is customary in the prior art.

FIG. 1 is a generalized drawing of the intake manifold-carburetor area of a vehicle such as an automobile. Air passes through air filter 1 into carburetor 7, which contains a valve generally known as a butterfly valve designated 2 and 3 in FIG. 1. When the engine is not functioning the butterfly valve is in position designated 2. However, upon acceleration the butterfly valve opens to position 3 and fuel enters the carburetor 7 through fuel line 6. A gasket 4 is used to connect carburetor 7 with the intake manifold 5, the connection generally being made by two bolts (not shown). The rate and amount of fuel-air mixture which passes from the carburetor into the intake manifold is obviously greater when the butterfly valve is open as in position 3 than at any other time. The butterfly valve assumes a position between 2 and 3 depending on the rate of acceleration and speed.

As is well known, vehicles, such as automobiles have a critical speed at which the most economical use is made of the fuel. As the United States government as determined such speed to be 55 mph at maximum, vehicles are not to be driven in excess of said speed. Thus, it is desirable to adjust those vehicles already in use in any easy manner to assure that the 55 mph speed is not exceeded. Of course, while there are some drivers who desire to not conform to such regulation, there are also those who wish to conform, but due to prior driving habits need some assistance.

Figure 2:
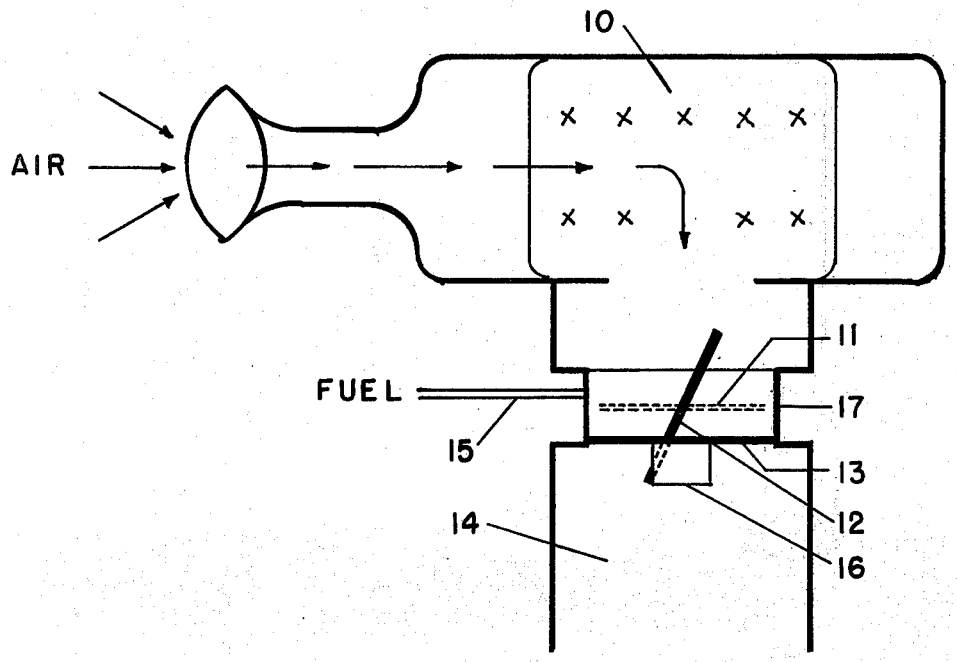
FIG. 2 is a drawing showing the same section of a vehicle wherein the apparatus of this invention is used.

FIG. 2 shows the intake manifold-carburetor area of the same vehicle as in FIG. 1. However, the gasket body 13 contains thereon a prohibiting or controlling means or appendage 16 to prevent the butterfly valve 11 and 12 from opening beyond a pre-selected point. The air filter is 10, the carburetor 17, the intake manifold 14 and fuel line 15. Position 11 represents the position of the butterfly valve when fully closed (engine not functioning) and 12 is the position most economical to the vehicle which is also the limit of opening as prohibited or controlled by 16.

Figure 3:
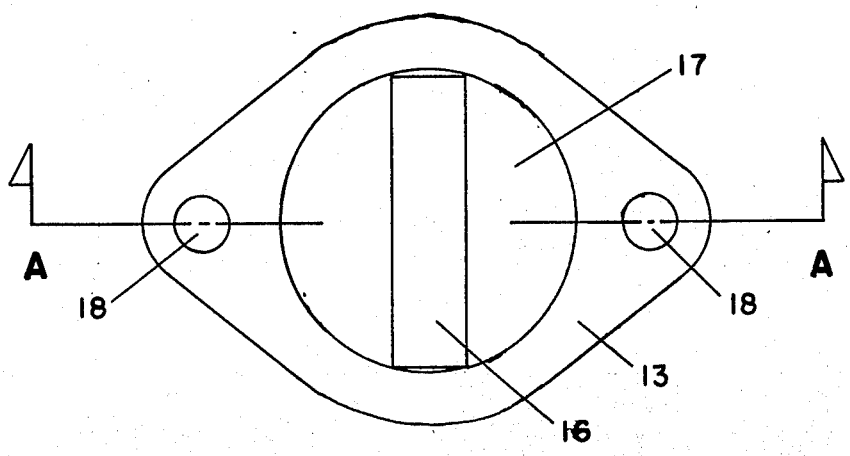
FIG. 3 is a top view of the improved gasket utilized in FIG. 2.
Figure 3A:
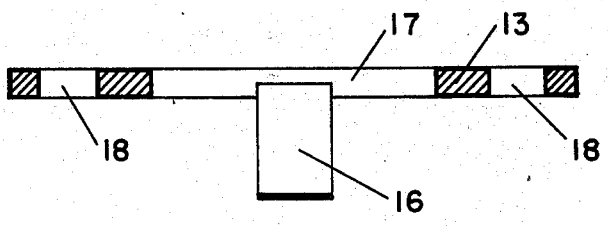
FIG. 3*a* is a side view of said improved gasket.

FIG. 3 is a top view of the improved gasket of this invention wherein the gasket body is 13; the prohibiting means or appendage to the gasket body is 16; 17 represents the area or aperture in which the butterfly valve (not shown) may operate; and 18 represents aperatures in which bolts fastening the intake manifold to the carburetor are inserted to securely fasten the intake manifold to the carburetor. FIG. 3*a* represents a side-view of the same improvement of the gasket body of FIG. 3.

The material which is used as the prohibiting means or appendage is formed or made from any material which is capable of withstanding the temperatures in the intake manifold-carburetor area. In one particular embodiment a gasket body for insertion between the carburetor and intake manifold of a 1969 Ford having a 390 cubic inches engine was fitted with the appendage as described heretofore. The appendage was made of 22 guage sheet metal and was formed so that the portion of the appendage designated 16 in FIG. 3*a* was ¾ deep and the appendage was ½ inch wide. The diameter of the circular aperture designated 17 was 2¼ inches and that of the bolt apertures 18 was ⅜ inch. It was found that upon using "regular" gasolene the miles per gallon was increased from 10 miles per gallon (mpg) to 14.8 mpg, or a saving of 48%. Of course, while a driver of a vehicle equipped with the thus described improved gasket, can still depress the accelerator as far as when the said improved gasket is not used, it will soon become readily apparent that such depression will not increase the speed of the vehicle and that no advantage can be gained from such action.

Of course, the particular size and shape of the improved gasket and appendage will vary with the different vehicles involved and the speed which is most economical for each vehicle, which determinations can be made through simple trial and error tests for each vehicle.

While the shape of the appendage has thus far been described as having three sides, it is not intended that such description be interpreted as being the only structure which may be utilized. Rather it will be clear to those skilled in the art that of gaskets and vehicles in general, that for certain vehicles a two-sided or "V"-shaped appendage will be more useful or that depending on the design of the intake manifold more than two angles may be desired in the prohibiting or controlling means (appendage). In other vehicles depending on the actual length of the butterfly valve, it will be desired that the appendage be nearly exactly, or exactly, in the plane of the gasket body. In other vehicles wherein dual carburetors are present on the vehicle, one gasket body will contain two apertures for the flow of fuel, each of which may contain the thus described appendage, so that in effect the improved gasket will resemble that shown in FIG. 3 except that the gasket body, carburetor etc. will all be duplicated.

While the particular material used to make the gasket body is not essential as long as the qualifications mentioned heretofore are followed, various gaskets and preparation of the same are fully described in several U.S. Pat. Nos. including 2,753,199 to Victor; 3,567,234 to Skrycki; 3,433,490 to Teucher et al; and 3,448,986 to Jelinek et al. As described in 2,753,199 to Victor, a sheet metal gasket may be coated with materials such as inorganic fillers, thermosetting resins and the like to provide a body which assists in forming a good seal between two bodies, e.g. intake manifold and carburetor. Of course, in all gaskets, there will be openings therein corresponding to the openings of the bodies between which the gasket is disposed.

As also described heretofore, the appendage to the gasket body should be sufficiently heat resistant to withstand heat in the area of the intake manifold and in the carburetor. In addition to sheet metal, various sturdy plastics may also be utilized.

One particular advantage of this particular invention is that no special equipment or changes are necessary in the design of the intake manifold and carburetor area of the vehicle, merely an exchange of the present gasket body for one of this invention. Of course, should the energy crises ease sufficiently to allow a more normal consumption of fuel and higher speed limits, the gasket of this invention which has been installed in a vehicle can just as easily then be replaced with a gasket body such as was originally on the vehicle, without an appendage.

It is, of course, also possible to modify other gaskets in vehicles as the improved gasket described herein. One such similar modification may be made to control the flow of air through the air filter into the carburetor, in order to regulate the available air for mixture with the fuel in the carburetor.

It can therefore be seen that this invention is not therefore limited to any particular details of construction and materials described, as many equivalents will suggest themselves to those skilled in the art.

What is claimed is:

1. An improved gasket comprising a gasket body and a multiple-sided appendage securely fastened to said gasket body in combination with a carburetor containing a fuel flow control valve and an intake manifold wherein said improved gasket is disposed between said carburetor and said intake manifold whereby said appendage of said gasket controls the extent to which said fuel flow control valve can open when said valve contacts said appendage, said fuel flow control valve controlling the flow of fuel from said carburetor to said intake manifold.

2. The improved gasket in combination with said carburetor and said intake manifold according to claim 1 wherein said fuel flow control valve is a butterfly valve.

3. The improved gasket in combination with said carburetor and said intake manifold according to claim 1 wherein the appendage has three sides and is shaped in the form of a "U".

4. The improved gasket in combination with said carburetor and said intake manifold according to claim 1 wherein the appendage extends a selected distance beneath the plane of the gasket whereby the angle to which said fuel flow control valve opens at its greatest degree of opening is that angle which provides the most efficient use of fuel as measured in terms of distance per unit of fuel.

5. The improved gasket according to claim 1 wherein the appendage is a material which is heat resistant to the temperature of the enviroment of the intake manifold and said carburetor.

* * * * *